United States Patent [19]

Schneider

[11] Patent Number: 4,676,373

[45] Date of Patent: Jun. 30, 1987

[54] PLASTIC PALLET CONTAINER

[76] Inventor: Helmhold Schneider, Petersbachweg 1, D-5230 Altenkirchen, Fed. Rep. of Germany

[21] Appl. No.: 797,969

[22] Filed: Nov. 14, 1985

[30] Foreign Application Priority Data

Nov. 20, 1984 [DE] Fed. Rep. of Germany ... 8433960[U]
Nov. 23, 1984 [DE] Fed. Rep. of Germany ..... 3442701

[51] Int. Cl.[4] ..... B65D 19/00
[52] U.S. Cl. ..... 206/386; 220/401; 206/600
[58] Field of Search ..... 206/386, 600, 597, 599; 220/401, 408, 18.1, 19

[56] References Cited

U.S. PATENT DOCUMENTS

| | | | |
|---|---|---|---|
| 4,165,024 | 8/1979 | Oswalt et al. | 206/386 |
| 4,174,046 | 11/1979 | Atkins | 206/386 |
| 4,361,232 | 11/1982 | Olmsted | 206/386 |
| 4,426,015 | 1/1984 | Preston et al. | 206/386 |
| 4,585,143 | 4/1986 | Fremon et al. | 206/386 |

FOREIGN PATENT DOCUMENTS

| | | | |
|---|---|---|---|
| 2510253 | 9/1976 | Fed. Rep. of Germany | 206/386 |
| 2754479 | 7/1978 | Fed. Rep. of Germany | 206/386 |
| 2139983 | 11/1984 | United Kingdom | 206/386 |

*Primary Examiner*—Joseph Man-Fu Moy
*Attorney, Agent, or Firm*—Spencer & Frank

[57] ABSTRACT

Pallet container unit for flowable substances, the container unit having a top and bottom, being arranged to rest via its bottom on a pallet, and being composed of: an inner container made of plastic and having a plurality of side walls and a bottom wall; and a supporting frame enclosing the inner container, the inner container having a drain fitting in one side wall in the vicinity of the bottom wall. The frame is in close contact with the inner container and is composed of a grating defining side walls of the frame and two tubular rims connected, respectively, to the grating at the top and bottom of the unit. The bottom wall of the container is arranged to rest on the pallet and the container has a curved bottom edge joining the bottom wall to the side walls. The unit further includes elements for engaging the rim at the bottom of the unit for securing the supporting frame to the pallet.

18 Claims, 14 Drawing Figures

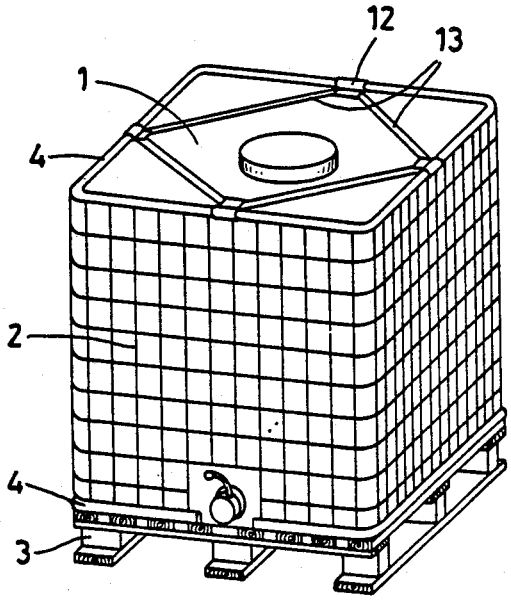
FIG.1
FIG.2
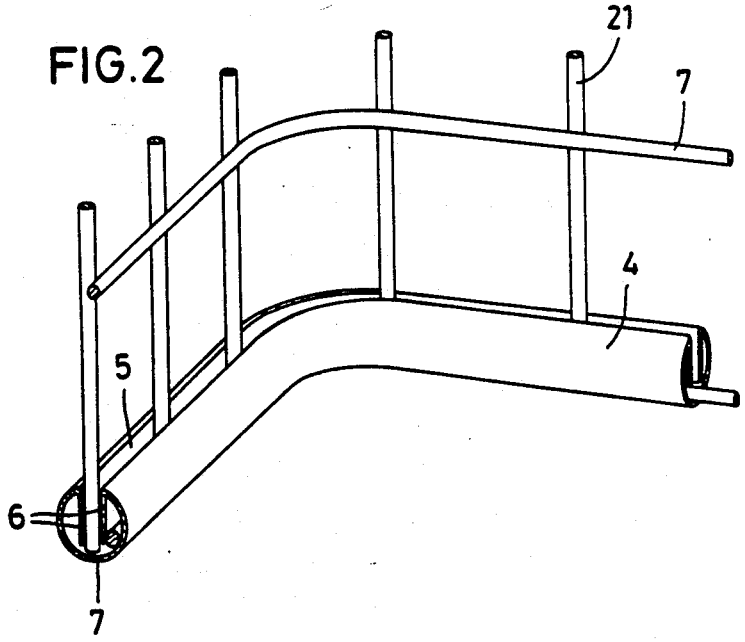

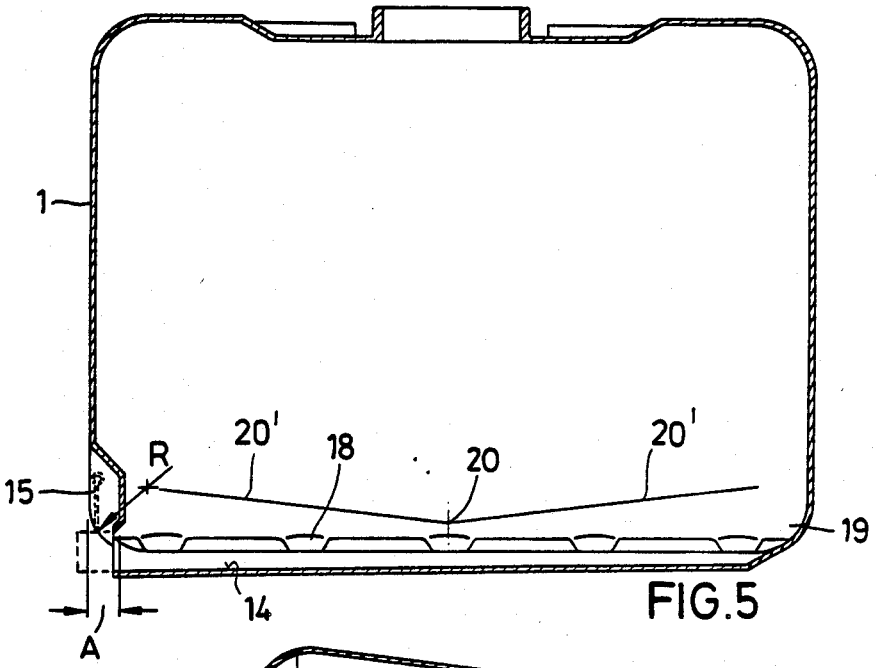
FIG.5
FIG.6
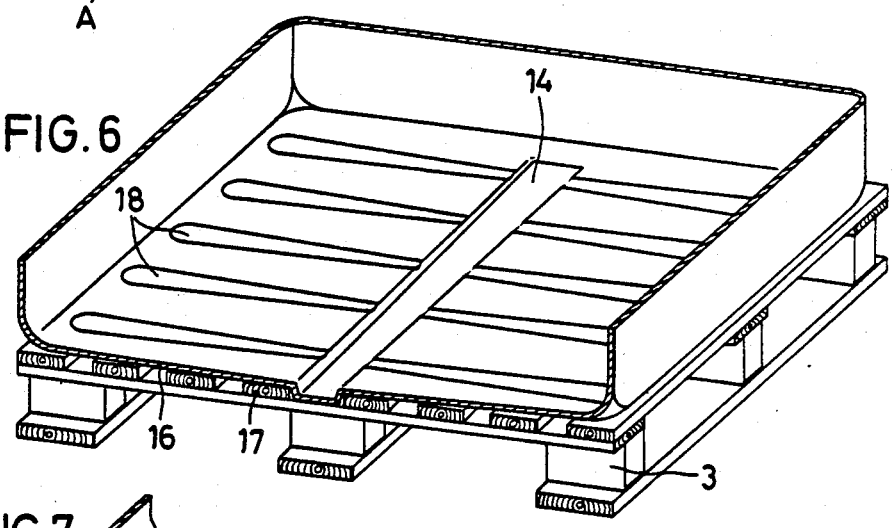
FIG.7
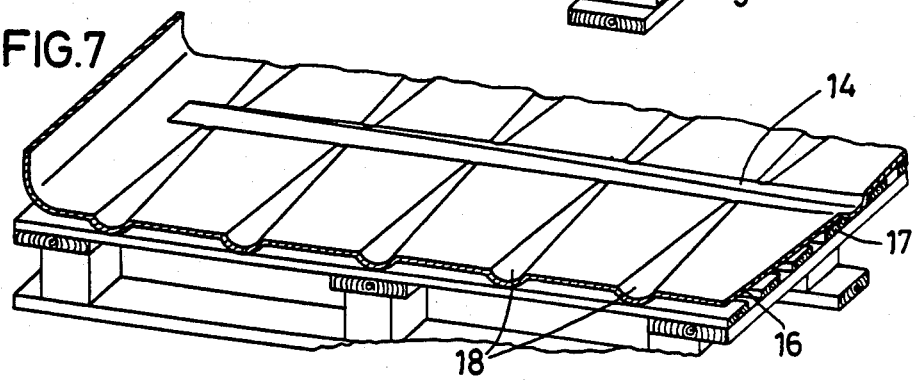

PLASTIC PALLET CONTAINER

BACKGROUND OF THE INVENTION

The present invention relates to a pallet container for flowable or pourable substances, wherein the container is provided with a preferably cubic interior container that is made of plastic and is surrounded by a supporting frame while being fastened on a pallet. In its bottom region, one side wall of the inner container is provided with discharging fittings.

A pallet container of the above described type is disclosed in German Pat. No. 2,545,023. That plastic inner container is surrounded by a closed sheet metal jacket with welded-on bottom, with the sheet metal jacket, which completely encloses the inner container, being fastened to a wood pallet by means of fastening claws.

The known pallet containers have a number of drawbacks. For example, when a pallet container is surrounded by a sheet metal jacket, fill level monitoring is possible only to an insufficient degree although viewing openings are provided in the sheet metal jacket. A further drawback is that the condition of the inner container cannot be detected from the outside. Possible damage can be located only with difficulty and frequently only with a delay in time so that the damage produced by the fill material can be kept within limits only with difficulty.

Such container is normally equipped with a lower discharge and an upper fill opening. If, upon emptying the container, the user forgets to unscrew the upper fill opening, the external air pressure compresses, or deforms, the inner container. This often makes the inner container unfit for further use and creates the additional danger that the formation of folds in the inner container makes it susceptible to damage from the outer sheet metal jacket.

A further drawback of inner containers surrounded by a sheet metal jacket is their insufficient stackability. For reasons of economy, very thin sheet metal is employed for the outer jacket, thereby considerably reducing stackability. Although, assuming perfect conditions, e.g. no dents in the sheet metal walls, two to three pallet containers can be stacked on top of one another, it frequently occurs during generally very rough loading dock operations that the containers to be stacked are set down rather abruptly so that the lowermost container wall is dented and the entire stack is in danger of tipping over.

Additionally, pallet containers made of plastic are known which are inserted into a stackable grate-type box so as to enable a plastic container of such size to be manipulatable by means of a stacking vehicle. Such a container is disclosed, for example, in German Utility Model Patent No. 1,910,944. The manufacture of such grate-type boxes is relatively expensive and additionally has the drawback that the angle profile welded to the upper and lower circumferential grate edge has only insufficient bending and twisting strength and thus the stability of the entire grate-type box is insufficient. The preferably spot-welded wire grate, particularly in cubic inner containers, serves the primary purpose of supporting the side walls of the inner container against the pressure of the fill material and of preventing buckling and thus destruction of the inner container. However, the ability of the wire grate to absorb the forces emanating from the fill material depends to a great degree on the thickness of the wire and on the narrowness of the wire mesh so that sufficient strength can here be realized only with the use of considerably more material. Deformation of the wire grate and thus buckling of the side walls of the inner container under the filling pressure can be prevented here only to the extent permitted by the stiffness of the box frame which is made of angle profiles. Due to the large expenditures for material and money involved in the manufacture of such grate-type boxes, these containers cannot be used, for reasons of economy, as one-way containers.

Although this is possible in connection with the abovementioned pallet container having a closed jacket made of thin sheet metal, one drawback of the completely encased pallet container is that it is impossible to monitor in any way the fill level in the container, or the condition of the interior of the plastic inner container and additionally there is no possibility of direct access if the inner container is damaged and thus could produce leaks, for example by laying the container on its side, since the location of the leakage cannot be determined from outside.

SUMMARY OF THE INVENTION

It is an object of the present invention to provide a pallet container of the above-mentioned type which can be manufactured economically so that its use as a one-way container is economically justified and which at the same time avoids the drawbacks of the prior art structural configurations.

The above and other objects are achieved, according to the invention, by a novel pallet container unit for flowable substances, the container unit having a top and bottom, being arranged to rest via its bottom on a pallet, and comprising: an inner container made of plastic and having a plurality of side walls and a bottom wall; and a supporting frame enclosing the inner container, the inner container having a drain fitting in one side wall in the vicinity of the bottom wall, according to the invention:

the frame is in close contact with the inner container;

the frame comprises a grating defining side walls of the frame and two tubular rims connected, respectively, to the grating at the top and bottom of the unit;

the bottom wall of the container is arranged to rest on the pallet and the container has a curved bottom edge joining the bottom wall to the side walls; and the unit further comprises means for engaging the rim at the bottom of the unit for securing the supporting frame to the pallet.

The upper and lower rims formed of tubular profiles create a frame structure of such rigidity that the forces exerted on the frame by the relatively flexible inner container are absorbed. Since, particularly, in a tubular profile having a symmetrical cross section, preferably a circular cross section, the form stability is identical in all directions, the forces imposed by the inner container on the rims and on the frame as well as the forces acting on the frame during transport and stacking are reliably absorbed. Compared to an angle profile of the same rigidity, a tubular profile having a smaller cross section and thinner walls can be used for the rims so that additionally there results a considerable reduction in material costs and also in the empty weight of such a pallet container.

In one embodiment of the invention, the high form stability of the upper and lower rims makes it possible to employ a grid structure with intersecting bars in the form of a preferably spot welded wire grid for enclosing the inner container, with this structure being in close contact with the inner container and the grid plane being congruent with the central axis of the tubular profile of each rim. The grid plane is here a vertical, plural-sided surface having the form of the frame and along which each grid wire or rod extends. This has the advantage that wire grids having a reduced wire thickness and practically no rigidity with respect to stresses occurring perpendicular to the plane of the grid can be used as the supporting frame. When stressed perpendicular to the plane of the grid, the grid surface is practically prevented from bending through since the pulling forces are absorbed by the rims.

Through the use of a spot-welded wire grid, i.e. a wire grid in which the intersecting rods are connected together at their points of intersection, the shape retention of the grid-type frame is further increased since even under local stresses which act perpendicular to the plane of the grid, as they occur, for example, in the center region of the side faces due to pressure of the fill material, relative shifts between the intersecting grid rods are impossible.

In a preferred embodiment of the invention, it is provided that, with a generally cubic inner container, vertical metal reinforcement sheets are disposed in the four edge regions between the wire grating and the inner container and are fixed to the upper and lower circumferential rims and these metal reinforcement sheets are in close contact with the wire grating. The thus configured composite structure between spot-welded wire grating and metal reinforcement sheets in the corner regions has such a high deformation resistance and such a high stack pressure resistance that very thin material cross sections can be used for the metal reinforcement sheets as well as for the wire grating, with additionally the wire grating being relatively wide meshed so that, in comparison to known structures, a considerable reduction in material costs results. Rigidity of the total structure is increased in one embodiment according to the invention by metal reinforcement sheets which are provided with vertically extending reinforcement ribs.

In a suitable embodiment of the invention, the upper and lower circumferential rims are each provided with a longitudinally extending, and hence circumferential, web and the vertical rods of the wire grating and the metal reinforcement sheets disposed at the corners are fastened, preferably by welding, to this web. The circumferential web at each rim additionally increases the bending strength of the circumferential rim with respect to forces acting in the plane of the grating. At the same time, the web provides a simple means for fastening the grating and the metal reinforcement sheets.

In another embodiment according to the invention, the tubular rim is provided with a longitudinal groove along its longitudinal axis, with such groove being defined by two inwardly bent webs whose length toward the interior of the tube is such that the last horizontally extending rod of the wire grating inserted into the longitudinal groove is held by the free end of a web and the inner diameter of this longitudinal groove corresponds to the thickness of the vertical rods of the wire grating. On the one hand, this results in manufacturing advantages in the acquisition of the tubular profile for the rims since such a tubular profile can be rolled simply and economically as a sheet metal profile and, on the other hand, manufacturing advantages result for the connection of the wire grating with the tubular profile since the wire grating is simply pushed into the longitudinal groove and is then held in a form locking manner by one of the inwardly bent webs in the manner of a snap connection.

In one suitable configuration according to the invention, this tubular profile, in particular, is used with a holding element which is provided with a fastening plate that is adapted to the tube radius and to which is shaped a web, or bar, that is supported at the bottom of the tube in the interior of the tube profile, with the thickness of such web being equal to the inner groove width of the tubular profile. The web is provided with a bore or passage for a fastening means. With this type of holding element, a form locking connection with the pallet is provided, particularly for a tubular profile equipped with a longitudinal groove, with such form locking connection simultaneously preventing widening of the profile and, on the other hand, permitting fastening of the supporting frame, by means of screws or nails, to the pallet, which is usually made of wood.

A particular advantage of the embodiment incorporating a profile having a longitudinal groove is that this provides a way to connect all parts without the need for welding while assuring high stability. This makes it possible to use material which was previously zinc-plated so that permanent corrosion protection is afforded. A particular advantage with respect to manufacturing is that the stretched tubular profiles are placed onto two opposite edges of a planar wire mat, or sheet, and then an appropriate bending device is used to simultaneously bend the system as a whole into the shape corresponding to the inner container.

Since, according to the present invention, the horizontally extending rods of the grating lie on the side facing the inner container, it is easier to effect the claw connection with the profiled webs of the tubular profile in the corner regions, thus increasing stability. In addition, the close contact of the wire grating with the inner container in the corner regions and the form locking introduction of the deformation forces also produce only slight buckling of the frame. These forces act through the inner container on its side walls, into the lower and upper circumferential tubular profiles of the rim. It is here of particular advantage that if a plurality of pallet containers are placed in close juxtaposition, they cannot get caught in one another along the horizontal rods.

In another embodiment according to the invention, the frame is formed by upper and lower circumferential tubular rims between which are arranged vertical grating struts which preferably have a tubular cross section and whose center axes intersect the longitudinal axes of the upper and lower rims. The number of struts distributed around the circumference is determined primarily by the resistance of the side walls of the inner container to bulging. Such a frame structure is able to absorb high pressure stresses, bending stresses and transverse forces, with the use of tubular cross sections resulting, due to its shape retention, in a considerable reduction of weight.

Advisably, in a further embodiment of the invention, the vertical struts of the structure are embedded in ribs, or recesses, in the side walls of the inner container so that better volume utilization of the region enclosed by the frame and greater rigidity of the connection between container and frame are realized.

In a particularly suitable embodiment of the invention, the frame structure is formed by a wire grid which is in close contact with the inner container and by vertical struts and the wire grid and the struts are fixed to the upper and lower rims. Since, in this embodiment, pressure stresses, particularly those from supervening units of a stack, are absorbed by the webs and bending stresses on the supporting frame as a result of the forces coming over the side walls and originating from the contents of the containers are essentially absorbed as well, this composite structure affords the possibility of employing a relatively wide meshed wire grid, spot-welded together of thin rods, which not only effectively counteracts buckling of the side walls of the inner container but also increases the stability of the connections in the entire structure without, however, adding to the net weight of the structure.

Advisably, the upper tubular rims are gripped, in the center of each side, with sheet metal clamps between which metal reinforcement sheets, strips, or bars are fastened. These metal reinforcement sheets form diagonal struts that bridge the corner regions of the frame and produce high transverse stability so that the inherent stability of a stack formed of a plurality of superposed pallet containers is significantly improved. In the case of a tubular profile rim having a longitudinal groove, the sheet-metal clamps additionally prevent widening of the groove. The configuration of the supporting frame according to the present invention, compared to the prior art pallet containers, results in considerably reduced use of material with increased stability. Depending on the particular configuration, the reduction of amount of material employed may be up to 50% of that employed in prior art structures so that a unit according to the invention has a considerably larger range of uses.

In a further embodiment of the invention, the bottom of the inner container is provided with a collecting trough which extends along the center of the bottom wall toward the discharge, or drain, fitting, preferably has a sloping bottom and, at least in part, is located in a recess of the pallet. In this connection, it is sufficient for the depth of the collecting trough at its lowest point to be no greater than the thickness of a board of the upper layer of boards of the wood pallet. Since the individual boards of the wood pallets are spaced from one another, this trough will thus not project downwardly below the upper layer of boards, so that insertion of the fork of a fork lift produces no danger of damage. This makes it possible to empty such a container completely without additional manipulations and no unused contents are left in the container, which results in a considerable cost saving for the user.

To further assure complete emptying, a further feature of the invention provides that the bottom of the inner container, at the inside of the container, slopes downwardly from two mutually opposite sides to the center of the bottom and the bottom is provided with downwardly convex, outwardly diverging supporting ribs which extend in the direction of the slopes, with the external faces of these ribs resting on pallet boards.

Since these supporting ribs inevitably extend transversely to the direction of the upper layer of boards of the wood pallet, as the collecting trough is parallel to the boards, the bottom has a sloped interior surface and still rests flatly on the horizontal pallet surface. Since the inner container is made of a resiliently deformable plastic, the container bottom, under pressure of the contents, will be deformed to rest flatly on the layer of boards of the wood pallet, at least when the container is filled to a substantial extent. As the container empties, however, the more the bottom surface will return to its original, or undeformed, shape so that finally the bottom surface will again assume the desired draining slope toward the collecting trough and thus the container will be emptied practically completely of any remaining material.

To further improve the emptying of the remaining material, the invention provides that the discharge fitting is disposed in a broad channel in one side wall and that the depth of the broad channel in the container wall is noticeably less than the radii of curvature at the corners of the container to both sides of the channel. In this way, a natural slope in the direction toward the drain is realized again.

Since the inner container required to implement the present invention is preferably made in a blow molding process of a high density polyethylene, the corner radii must be appropriate, for process engineering reasons, to the realization of a uniform wall thickness distribution. The walls here are naturally thinnest in the corners and thickest in the wall surfaces. To prevent now that the inner container may tear under pressure in the thinnest corner regions under the pressure of the container contents, it is known to provide, along the lower edge of the inner container between the supporting frame and the inner container, an additional supporting element which rests flatly against the lower edge of the inner container so as to prevent deformation of the inner container in this region. This has the drawback of requiring an additional component and, due to the required large corner radii, the drawback of poorer space utilization, if the interior defined by the supporting frame is considered the maximum usable area.

One feature of the present invention therefore provides that the radius of the lower rounded portions, or edges, of the inner container on all four sides decreases steadily in size from a large corner radius in the corners of the container to a small edge radius at the center of each side. The reduction in wall thickness required to accomplish this is insignificant because, particularly in the region of the reduced radius at the center of a side, greater wall thicknesses exist as a result of the manufacturing process. Since, on the other hand, the side walls of the inner container are supported by the outer wire frame, no reduction in strength occurs. Yet space utilization is improved.

Flowable substances in the sense of the present invention are not only liquid fill materials, but also pasty and pourable substances, i.e. powdered and granulate fill materials.

BRIEF DESCRIPTION OF THE DRAWINGS

FIG. 1 is a perspective view of a pallet container according to the invention having a grate-like frame of intersecting rods.

FIG. 2 is a perspective detail view showing the shape of the lower and upper circumferential rims in the embodiment according to FIG. 1.

FIG. 5 is an elevational cross-sectional view of an inner container in the plane of a lower collecting trough.

FIG. 6 is a perspective detail view, partially in section, of the bottom region of an inner container and pallet, including an arrangement of supporting ribs at the inner container bottom.

FIG. 7 is another perspective detail view of the bottom region of the structure shown in FIG. 6.

DESCRIPTION OF THE PREFERRED EMBODIMENTS

Figure 3:
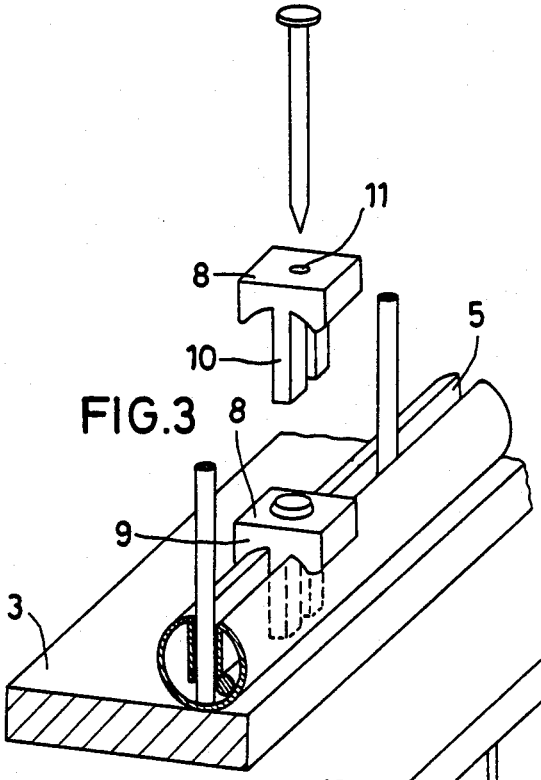
FIG. 3 is a perspective detail view showing the manner in which the grate-like frame is fastened to a pallet.

FIG. 1 is a perspective view of a pallet container according to the invention in which an inner container 1 made of plastic is surrounded by a grid-, or grate-like frame 2 formed of intersecting rods which closely contact inner container 1. Grid-like frame 2 is delimited at its top and bottom by respective circumferential rims 4 made from tubular profile structures and fixed to grid-like frame 2.

The lower circumferential rim 4 is fastened to a standard wood pallet 3 by means of holding elements so that the pallet container as a whole can be manipulated by means of a fork stacker or other lifting devices. The upper circumferential rim 4 is provided at the center of each side with a clamp 12 made of sheet metal. Metal reinforcement sheets, or bars, 13 are fastened to clamps 12 and extend diagonally over the respective corner regions to prevent the central regions of the upper rim sides from spreading out, or bowing. The bars 13 are fixed to clamps 12 by a riveting or a welding operation.

FIG. 2 shows, to a larger scale, the connection between wire grid 2 and the lower rim 4. The wire grid is here composed of intersecting horizontal rods 7 and vertical rods 21, with the horizontally extending rods 7 lying on the side of rods 21 facing the inner container. Horizontally extending rods 7 are permanently connected to vertically extending rods 21, for example by means of spot welding.

As can be seen in FIG. 2, the tubular profile of rim 4 is provided with web sheets 6 which are angled toward the interior of the profile to form a longitudinal groove 5. If now wire grid 2 is cut in such a way that its lower edge is defined by a horizontally extending rod 7, the wire grid can be inserted into the longitudinal groove in such a manner that the lowermost horizontally extending rod 7 is held in a form locking manner by the associated web sheet 6 of the tubular profile. The width of groove 5 here corresponds to the thickness of vertical rods 21. The rim 4 at the tip of grate 2 has a identical structure.

Wire grid 2 may here be inserted into longitudinal groove 5 while being resiliently deformed. Advisably, however, the manufacturing process is carried out in such a way that suitable tubular profiles, each of the shape shown in FIG. 2, are pushed onto the upper and lower edges of a suitably dimensioned wire grid pattern and then the cut wire grid piece, together with the two attached tubular profiles, is bent into its intended shape in a suitable apparatus.

FIG. 3 shows, in a partly exploded view, a fastening element 8. This fastening element is composed of an upper fastening plate 9 adapted to the tubular shape of rim 4 and, at its underside, a web 10 which can be placed into the longitudinal groove 5 of the tubular profile and whose length is dimensioned such that it is supported by the inner wall of the cylindrical part of the tubular profile. A bore 11 passes through fastening plate 9 and web 10 so that, after insertion of fastening element 8 into the tubular profile, a nail can be driven through this bore or a screw can be screwed there into to hold the grate-like frame at the corresponding part of pallet 3.

Figure 4:
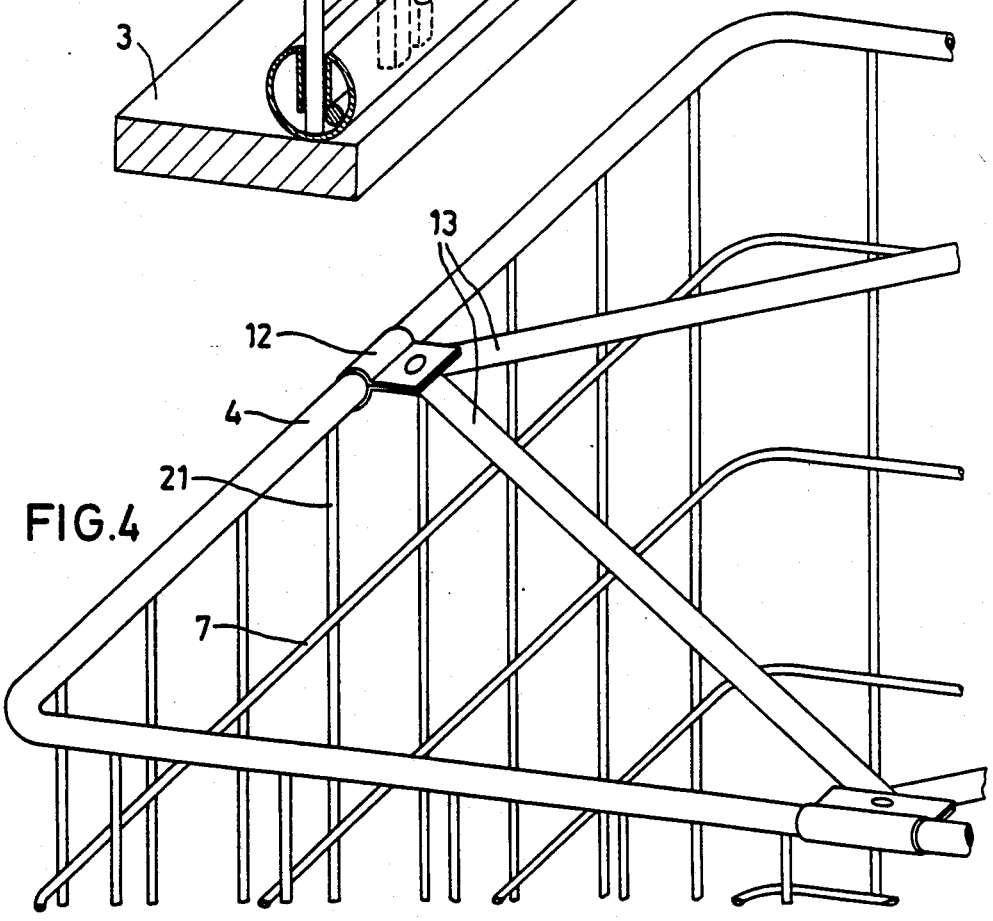
FIG. 4 is a perspective view showing a diagonal strut at the upper rim.

FIG. 4 again shows, to an enlarged scale, the diagonal corner struts stabilizing the upper rim 4.

As shown in the elevational, cross-sectional view of the inner container 1 in FIG. 5, inner container 1 is provided, in its bottom region, with a collecting trough 14 which extends over the bottom of the container and is sloped toward a drain. The plane of FIG. 5 bisects container 1 and trough 14. The drain is provided with a drain fitting and shown schematically by dotted lines at the lower end of trough 14, for example, an outlet valve, a screw tap or the like, and is disposed in a broad recess 15 which is inset from the container side wall by a distanace A which is less than radius of curvature R at each corner of the container associated with that side wall. At least at the two side walls extending parallel to collecting trough 14, the lower container edges are configured in such a manner that, starting from a large corner radius 19, they steadily decrease in size toward the center of the edge to attain a smaller center radius 20. Lines 20° in FIG. 5 show the borderlines between the planar part of the walls and the curvature of each such lower edge. The large corner radius 19 may measuring 100 mm continuously decreasing towards the center radius 20 of about 40 mm.

As shown in FIGS. 6 and 7, the container bottom is provided with a slope starting at the two opposite sides which are parallel to trough 14 and extending towards collecting trough 14, and with supporting ribs, or channels, 18 which rest with their outer, downwardly directed, faces on pallet boards 17. The collecting trough 14 here lies in the space between two adjacent pallet boards 17 while supporting ribs 18 extend transversely thereto. Channels 18 are emptied finally by tilting the container from both sides towards trough 14, so that the fill material can flow easily to the drain fitting at its lower end.

Figure 8:
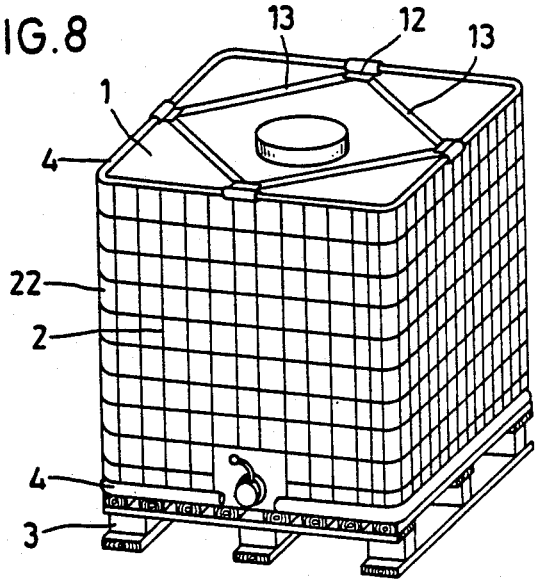
FIG. 8 is a view similar to that of FIG. 1 of a further embodiment of a pallet container including a grate-like structure of intersecting rods and metal reinforcement sheets in the corner region.
Figure 9:
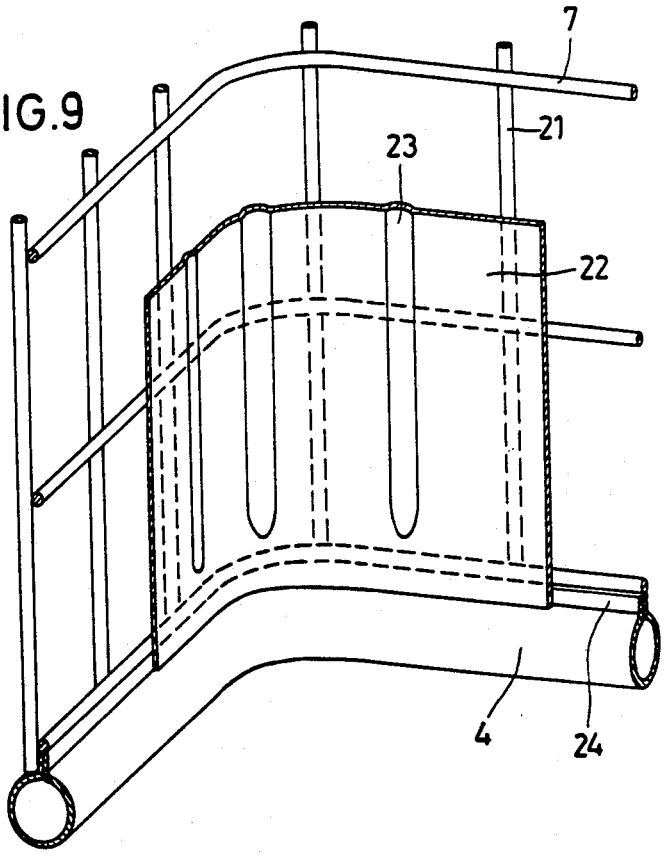
FIG. 9 is a view similar to that of FIG. 2 of a corner region of the embodiment according to FIG. 8.

In the embodiment shown in FIG. 8, which is provided with a grid-like frame structure 2, metal reinforcement sheets 22 are additionally provided in the corner regions of the frame. The configuration of, and the manner of fastening, metal reinforcement sheets 22 are shown to an enlarged scale in FIG. 9. The tubular profile of the lower rim 4, as well as of the upper rim, is here provided with an attached longitudinally extending web 24 to which the gridlike frame 2 is fastened with the vertical rods 21 being fastened, for example by welding, to the outside of web 24 and the metal reinforcement sheets 22 in the corner regions fastened to the inside of web 24, for example also by welding. The lowest horizontal rod 7 rests on top of web 24 and may be fastened thereto as by welding. FIG. 9 also shows vertical reinforcement ribs, or channels, 23 formed in streets 22 in the vicinity of the frame corners.

Figure 10:
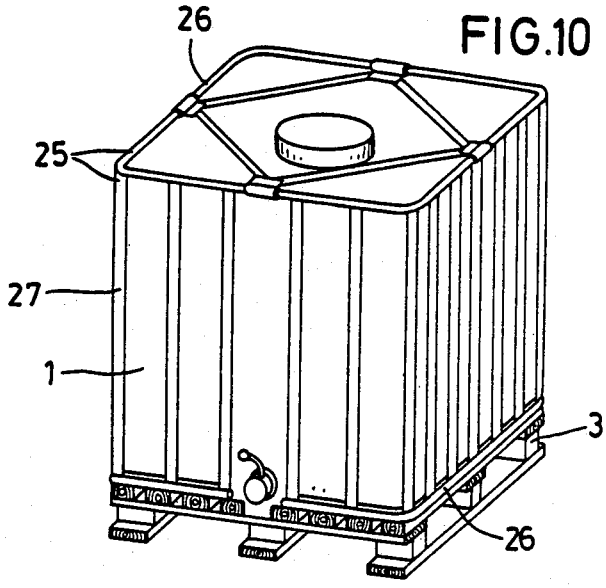
FIG. 10 is a view similar to that of FIG. 1 of an embodiment having a grate-like structure formed of vertical struts.
Figure 11:
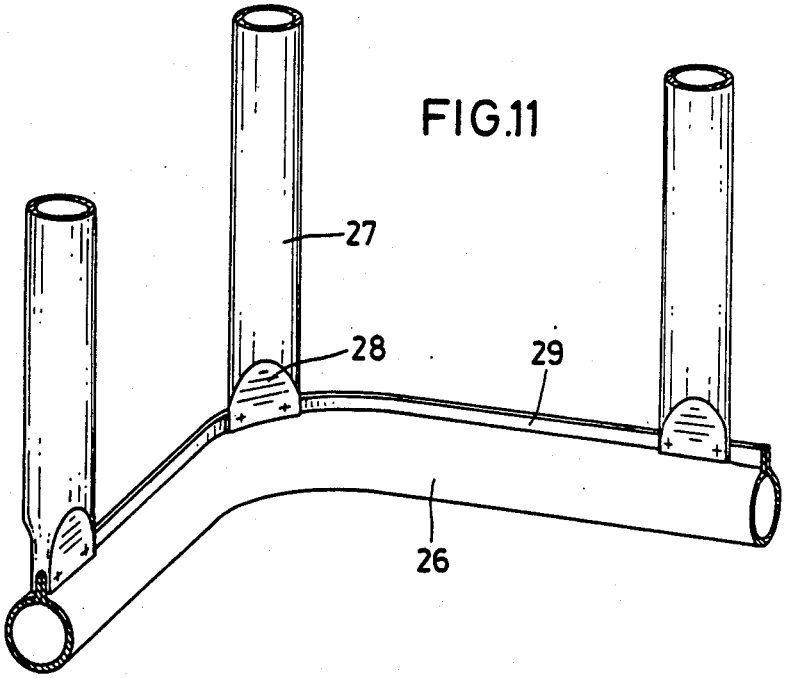
FIG. 11 is a view similar to that of FIG. 2 showing the connections between strut and rim in the embodiment according to FIG. 10 to a enlarged scale.

The embodiment according to FIG. 10 has a frame with a grating structure formed of vertical struts 27 which connect the upper and lower rims 26 made of tubular profile structures. Vertical struts 27 likewise preferably have a tubular cross section and, as shown in FIG. 11, their ends are flattened in such a manner that flange-like fastening ends 28 result which permit connection, by welding, riveting, screwing or the like, with webs 29 extending along, and projecting from, rims 26.

Figure 12:
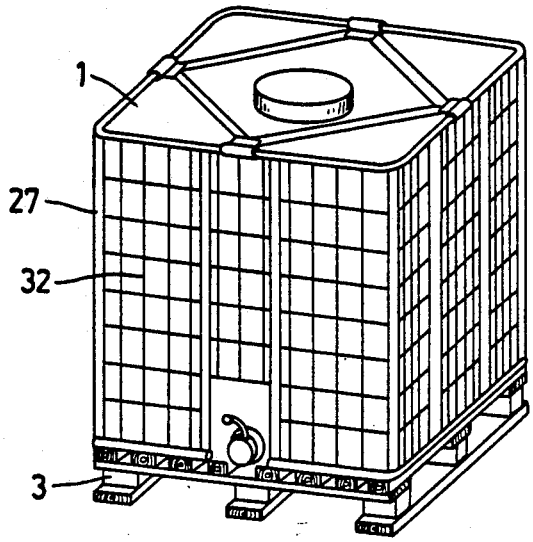
FIG. 12 is a view similar to that of FIG. 1 of an embodiment including a grate-like structure of vertical struts with an additional wide mesh spot welded wire grate.
Figure 13:
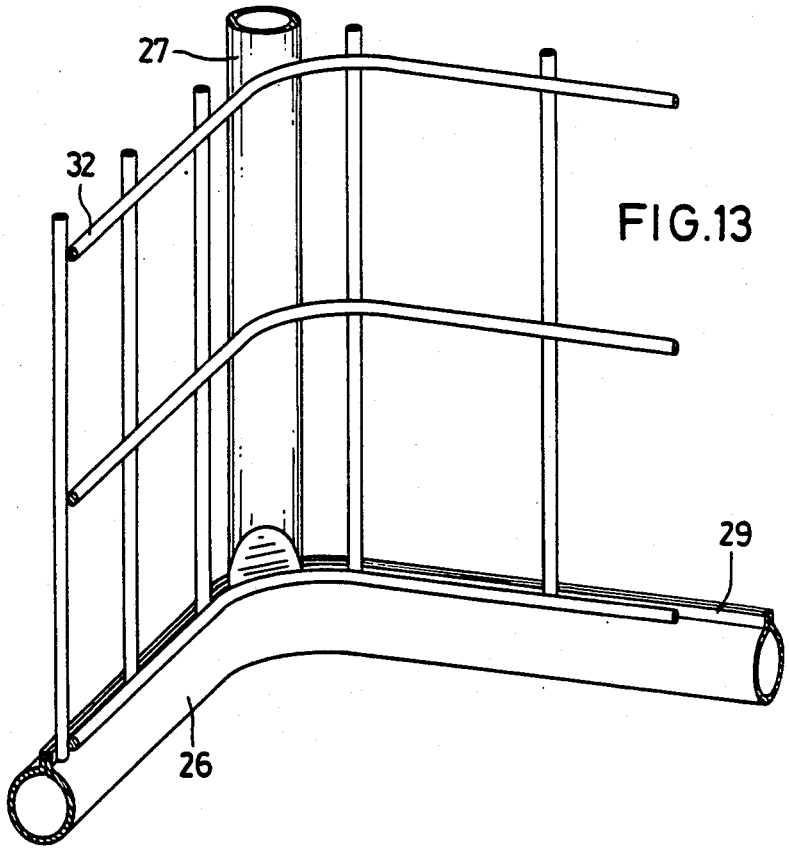
FIG. 13 is a view similar to that of FIG. 2 showing the fastening of vertical struts and wire grate to the rim of the embodiment of FIG. 12.

FIGS. 12 and 13 show an embodiment which is modified compared to that of FIG. 10 in that a grate-like frame formed of vertical struts 27 is additionally combined with a wide-mesh spot welded wire grid 32, with vertical struts 27 being disposed essentially at the corners of the frame and in the center region of the frame sides. Vertical struts 27 essentially absorb the stack pressure and support particularly the corner regions of the side walls of the inner container which is especially sensitive to buckling, while wire grid 32 provides full area support of the remaining wall regions of the inner container. The connection with vertical struts 27 simultaneously increases the shape retention of the entire supporting frame. Due to the rigidity of this structure the wire grid 32 does not need any fixation with struts 27 by welding or the like.

FIG. 13 again shows, to an enlarged scale, the fastening of vertical struts 27 and of wire grid 32 to a web 29 of the tubular profile structure forming lower rim 26.

Figure 14:
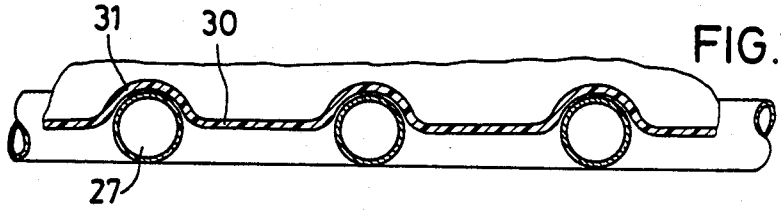
FIG. 14 is a cross-sectional plan view, to an enlarged scale, of the configuration of the walls of the inner container in the embodiment of FIG. 10.

FIG. 14 shows a special configuration of the inner container suitable for the embodiment of FIG. 10. In this configuration of the frame, the side walls 30 of inner container 1 are advisably provided with vertical ribs, or recesses, 31 during its manufacture, with the cross section and spacing of the ribs being such that vertical struts 27 of the frame are nested in the hollows formed by ribs 31. This configuration simultaneously results in a form locking connection between inner container 1 and frame 27, 32 so that again mutual support of connected elements and thus increase in shape retention is realized without adding weight.

All above described embodiments have in common that the walls of the inner container are visible from all sides. Since customarily such inner containers are made of a transparent plastic, the fill level can be monitored from all sides during filling as well as during later withdrawal of material. Moreover, the condition of the inner container can be checked at any time. Even leaks occurring during transport and storage can be detected at once and further loss of contents can be prevented by the "first aid" measure of placing the container on its side with the damaged container wall facing upward.

It will be understood that the above description of the present invention is susceptible to various modifications, changes and adaptations, and the same are intended to be comprehended within the meaning and range of equivalents of the appended claims.

What is claimed is:

1. A pallet container unit for flowable substances, said container unit having a top and bottom, being arranged to rest via its bottom on a pallet, and comprising: an inner container made of plastic and having a plurality of side walls and a bottom wall, and a supporting frame enclosing said inner container, said inner container having a drain fitting in one side wall in the vicinity of said bottom wall, wherein:

said frame is in close contact with said inner container;

said frame comprises a grating defining side walls of said frame and two tubular rims connected, respectively, to said grating at said top and bottom of said unit;

said bottom wall of said container is arranged to rest on the pallet and said container has a curved bottom edge joining said bottom wall to said side walls;

said container has a self-sustaining shape and is provided with a discharge fitting in the vicinity of said bottom wall, and said bottom wall is formed to provide, at the interior of said container, a collecting trough extending along the center of said bottom wall toward said fitting and arranged to be disposed at least partially in a recess of the pallet; and said unit further comprises means for engaging said rim at bottom of said unit for securing said supporting frame to the pallet.

2. A unit as defined in claim 1 wherein said grating comprises a plurality of intersecting rods arranged in a plane congruent with the central axes of said rims.

3. A unit as defined in claim 1 wherein said inner container has a cubical form.

4. A unit as defined in claim 3 wherein the side walls of said frame meet at vertical frame edges and said supporting frame further comprises metal reinforcing sheets disposed at the frame edges and interposed between said grating and said inner container, said sheets being fastened to said rims and being in close contact with said grating.

5. A unit as defined in claim 4 wherein each of said sheets is provided with vertically extending reinforcing ribs.

6. A unit as defined in claim 4 wherein said grating is composed of horizontal and vertical rods, each of said rims comprises a web projecting laterally from, and extending longitudinally along, its associated rim, and each said sheet and each said vertical rod are fastened to said web of each said rim.

7. A unit as defined in claim 1 wherein: said grating comprises horizontal and vertical rods and said grating is bounded, at the top and bottom of said unit, by respective horizontal rods; each said rim has a longitudinal axis and comprises a hollow tube provided with two inwardly directed longitudinal webs located to opposite side of said longitudinal axis and delimiting a longitudinal groove which is open along the side of said rim which is directed toward the other said rim; said grating is inserted, at the top and bottom of said unit, into said rims with said vertical rods extending into said grooves and a respective horizontal rod bounding said grating being interposed between the end of one said web and said hollow tube of a respective rim; the width of each said groove corresponds to the thickness of said vertical rods; and said one web of each said tube is dimensioned for causing the respective horizontal rod bounding said grating to be gripped between said one web and said tube.

8. A unit as defined in claim 1 wherein said grating is composed of horizontal and vertical rods and said horizontal rods are located between said vertical rods and said inner container.

9. A unit as defined in claim 1 wherein said grating comprises vertical struts connected between said rims.

10. A unit as defined in claim 9 wherein each said strut and each said rim has a tubular cross section with a center longitudinal axis, and the longitudinal axes of said struts intersect the longitudinal axes of said rims.

11. A unit as defined in claim 10 wherein: each said strut has two ends and is provided with a fastening flange at each said web; each said rim comprises a web extending parallel to said longitudinal axis of said rim; and each said fastening flange of each said strut is fixed to said web of a respective rim.

12. A unit as defined in claim 9 wherein said side walls of said inner container are provided with inwardly-directed, vertically extending recesses and each said strut is nested in a respective recess.

13. A unit as defined in claim 1 wherein said grating comprises a wire grid in close contact with said inner container and a plurality of vertical struts, and said grid and said struts are fixed to said rims.

14. A unit as defined in claim 1 wherein said rim at said bottom of said unit is a hollow tube having a longitudinal groove open along the side of said rim which is directed toward the other said rim, and said means for engaging said rim at said bottom of said nut comprise at least one holding element having an upper holding plate shaped to conform to the outer surface of said hollow tube, and a bar fixed to said holding plate and configured to extend into said groove and to bear against said tube a the side thereof directed away from the other said rim, said bar having a thickness equal to the width of said groove, and said holding plate and said bar being provided with a passage for receiving a device for fastening said holding element to the pallet.

15. A unit as defined in claim 1 wherein said frame has four side walls and further comprises: four sheet metal clamps each surrounding, and fastened to, said rim at said top of said unit at the center of a respective side wall of said frames; and four metal reinforcing strips each fastened between two respective clamps which are fastened to two adjacent side walls of said frame.

16. A unit as defined in claim 1 wherein said inner container has four side walls, said bottom wall of said inner container is formed to present a bottom surface at the interior of said inner container which slopes downwardly from two opposed side walls of said inner container toward said trough, and said bottom wall is provided with downwardly protruding supporting ribs which extend between said trough and said two opposed side walls and which have outer surfaces arranged to rest on the pallet.

17. A unit as defined in claim 1 wherein said inner container has four side walls and said curved bottom edge of said container has a radius of armature which, along each said side wall, varies progressively from a maximum value at each extremity of said side wall to a minimum value at the center of said side wall.

18. A unit as defined in claim 17 wherein one side wall or said inner container is formed to have a broad channel which is inset from the remainder of said one side wall by a distance which is smaller than the radius of curvature of said curved bottom edge at each extremity of said one side wall, and said container has a discharge fitting in said broad channel.

* * * * *